US008124496B2

(12) United States Patent
Su et al.

(10) Patent No.: US 8,124,496 B2
(45) Date of Patent: Feb. 28, 2012

(54) CABLE CONNECTOR ASSEMBLY WITH IMPROVED PRINTED CIRCUIT BOARD

(75) Inventors: Ping-Sheng Su, Tu-Cheng (TW); Dou-Feng Wu, Kunshan (CN); Wei Zhang, Kunshan (CN); Da-Wei Xing, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/953,384

(22) Filed: Nov. 23, 2010

(65) Prior Publication Data

US 2011/0124220 A1 May 26, 2011

(30) Foreign Application Priority Data

Nov. 24, 2009 (CN) ..... 2009 2 0315576

(51) Int. Cl.
*H01R 13/58* (2006.01)

(52) U.S. Cl. ..... 438/449

(58) Field of Classification Search ..... 439/449, 439/76.1, 490

See application file for complete search history.

(56) References Cited

U.S. PATENT DOCUMENTS 4,907,132 A * 3/1990 Parker ..... 362/556

(Continued)

FOREIGN PATENT DOCUMENTS

CN 201252264 Y 6/2009

*Primary Examiner* — Tulsidas C Patel
*Assistant Examiner* — Vladimir Imas
(74) *Attorney, Agent, or Firm* — Wei Te Chung; Andrew C. Cheng; Ming Chieh Chang

(57) ABSTRACT

A cable connector assembly (100) comprises a mating member (3) assembled with a plurality of contacts (33, 34), a printed circuit board (2), a cable (7) having a plurality of wires (71) and a strain relief portion (72), and a light pipe located (4) between the printed circuit board and the strain relief portion. The printed circuit board is attached with a LED (24), and the LED is electrically connected with the contacts. The printed circuit board defines a front surface, a rear surface and a cutout (23) extending through the front surface and the rear surface along a mating direction, and the LED is disposed behind the rear surface of the printed circuit board, the wires are extending through the cutout of the printed circuit board and soldered to the contacts in front of the printed circuit board.

18 Claims, 6 Drawing Sheets

U.S. PATENT DOCUMENTS 5,732,176 A * 3/1998 Savage, Jr. ..... 385/92
6,165,006 A * 12/2000 Yeh et al. ..... 439/490
6,572,402 B2 * 6/2003 Lin ..... 439/490
6,663,415 B1 * 12/2003 Wu ..... 439/460
6,971,913 B1 * 12/2005 Chu ..... 439/582
7,094,104 B1 * 8/2006 Burke et al. ..... 439/620.01
7,186,144 B1 * 3/2007 Khemakhem et al. ... 439/620.03
7,217,142 B1 * 5/2007 Wu ..... 439/79
7,247,046 B1 * 7/2007 Wu ..... 439/490
7,306,479 B1 * 12/2007 Wu ..... 439/497
7,329,151 B2 * 2/2008 Wu et al. ..... 439/607.41
7,429,188 B2 * 9/2008 Wu ..... 439/490
7,540,773 B2 * 6/2009 Ko ..... 439/581
7,614,913 B2 * 11/2009 Ice ..... 439/607.05
7,722,363 B2 * 5/2010 Zhou et al. ..... 439/76.1
7,753,689 B1 * 7/2010 Wu ..... 439/63
7,789,675 B2 * 9/2010 Zhang et al. ..... 439/76.1
7,854,634 B2 * 12/2010 Filipon et al. ..... 439/676
7,857,666 B2 * 12/2010 Chen et al. ..... 439/675
7,914,320 B2 * 3/2011 Ko ..... 439/490
7,927,146 B2 * 4/2011 Wu et al. ..... 439/607.57
7,963,773 B2 * 6/2011 Palli et al. ..... 439/38
2002/0019596 A1 * 2/2002 Eggers et al. ..... 600/564
2008/0003867 A1 * 1/2008 Wu ..... 439/490
2008/0003881 A1 * 1/2008 Wu ..... 439/610
2008/0200758 A1 * 8/2008 Orbay et al. ..... 600/112
2008/0305658 A1 * 12/2008 Ko ..... 439/76.1
2009/0004917 A1 * 1/2009 Ice ..... 439/610
2009/0269943 A1 * 10/2009 Palli et al. ..... 439/39
2009/0269972 A1 * 10/2009 Zhou et al. ..... 439/460
2010/0291791 A1 * 11/2010 Ko ..... 439/449
2011/0092081 A1 * 4/2011 Gao et al. ..... 439/40

* cited by examiner

CABLE CONNECTOR ASSEMBLY WITH IMPROVED PRINTED CIRCUIT BOARD

BACKGROUND OF THE INVENTION

1. Field of the Invention

The present invention generally relates to a cable connector assembly, and more particularly to a cable connector assembly transmitting power signal.

2. Description of Related Art

Nowadays, cable connector assemblies are widely used in an electronic equipment, especially for transmitting power, and the performance of the cable connector assembly directly impacts on the entire electronic equipment whether can normally run.

CN patent No. 201252264Y issued to Zhang on Jun. 3, 2009 discloses a conventional cable connector assembly, the cable connector assembly comprises an inner print circuit board, a LED attached on the print circuit board to indicate the work status of the cable connector assembly, a light pipe receiving the LED, a cable with a plurality of wires, a plurality of contacts connected with the cable, a mating member, and an insulated shell enclosing the print circuit board, the LED, the light pipe, the cable and the mating member partially. One of the contacts is inserted through a central hole in the printed circuit board and electrically connected with the central hole, and one of the wires is passing through an aperture on lateral side of the printed circuit board and soldered to the aperture. However, the cable connector assembly is designed more and more smaller, and the electronic components are defined on the printed circuit board densely, and the electronic components may be destroyed while soldering the cable or contacts to the printed circuit board.

Hence, it is desirable to have an improved structure to overcome the above-mentioned disadvantages of the prior art.

BRIEF SUMMARY OF THE INVENTION

Accordingly, the object of the present invention is to provide a cable connector assembly to prevent electronic components on a printed circuit board thereof being destroyed.

In order to achieve the above-mentioned object, a cable connector assembly in accordance with the present invention comprises a mating member assembled with a plurality of contacts, a printed circuit board, a cable having a plurality of wires and a strain relief portion, and a light pipe located between the printed circuit board and the strain relief portion. The printed circuit board is attached with a LED, and the LED is electrically connected with the contacts. The printed circuit board defines a front surface, a rear surface and a cutout extending through the front surface and the rear surface along a mating direction, and the LED is disposed behind the rear surface of the printed circuit board, the wires are extending through the cutout of the printed circuit board and soldered to the contacts in front of the printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
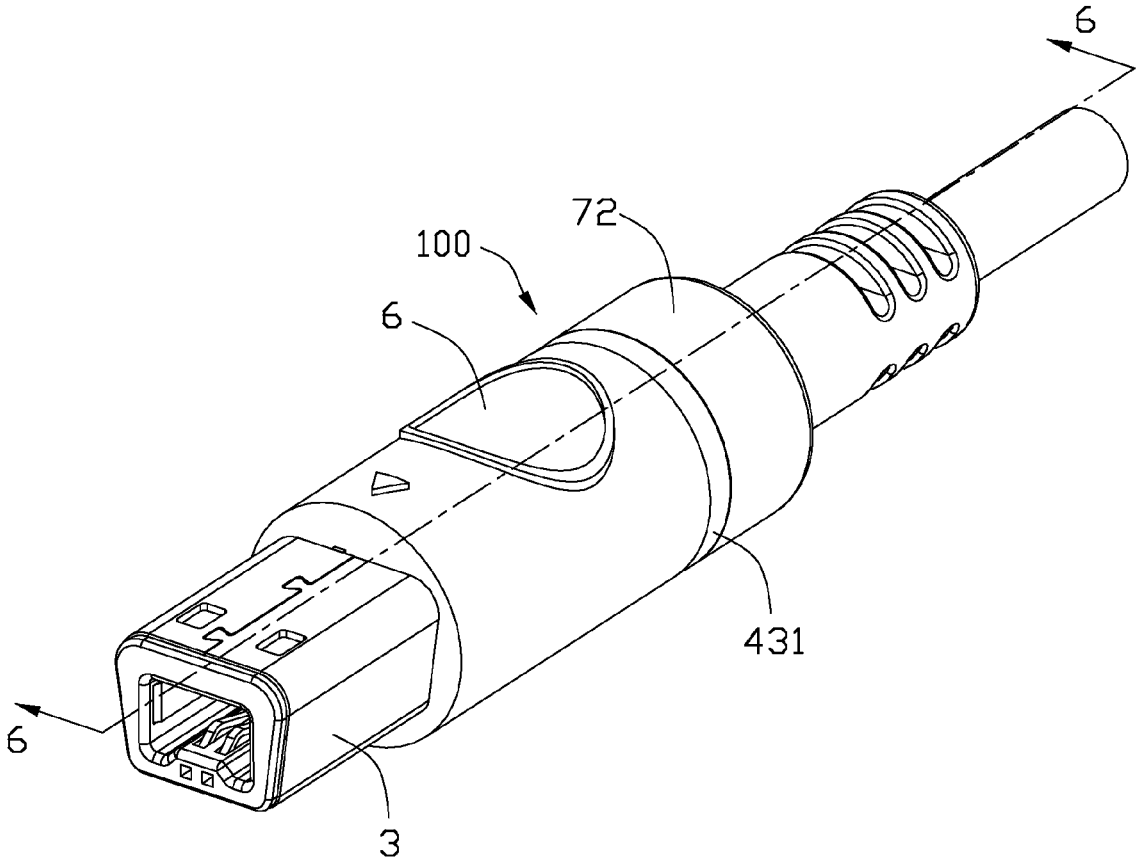
FIG. 1 is an assembled view of a cable connector assembly in accordance with the present invention.

Reference will now be made to the drawing figures to describe the present invention in detail.

Referring to FIGS. 1-5, a cable connector assembly 100 made in accordance with the present invention comprises a printed circuit board 2 perpendicular to a mating direction, a mating member 3 arranged in front of the printed circuit board 2, a light pipe 4 behind the printed circuit board 2, an inner cover 5 molded on the printed circuit board 2, the light pipe 4 and the mating member 3, an outer cover 6 and a cable 7 with a plurality of wires 71. The inner cover 5 defines a ringed depression (not labeled) on a back end thereof.

Figure 2:
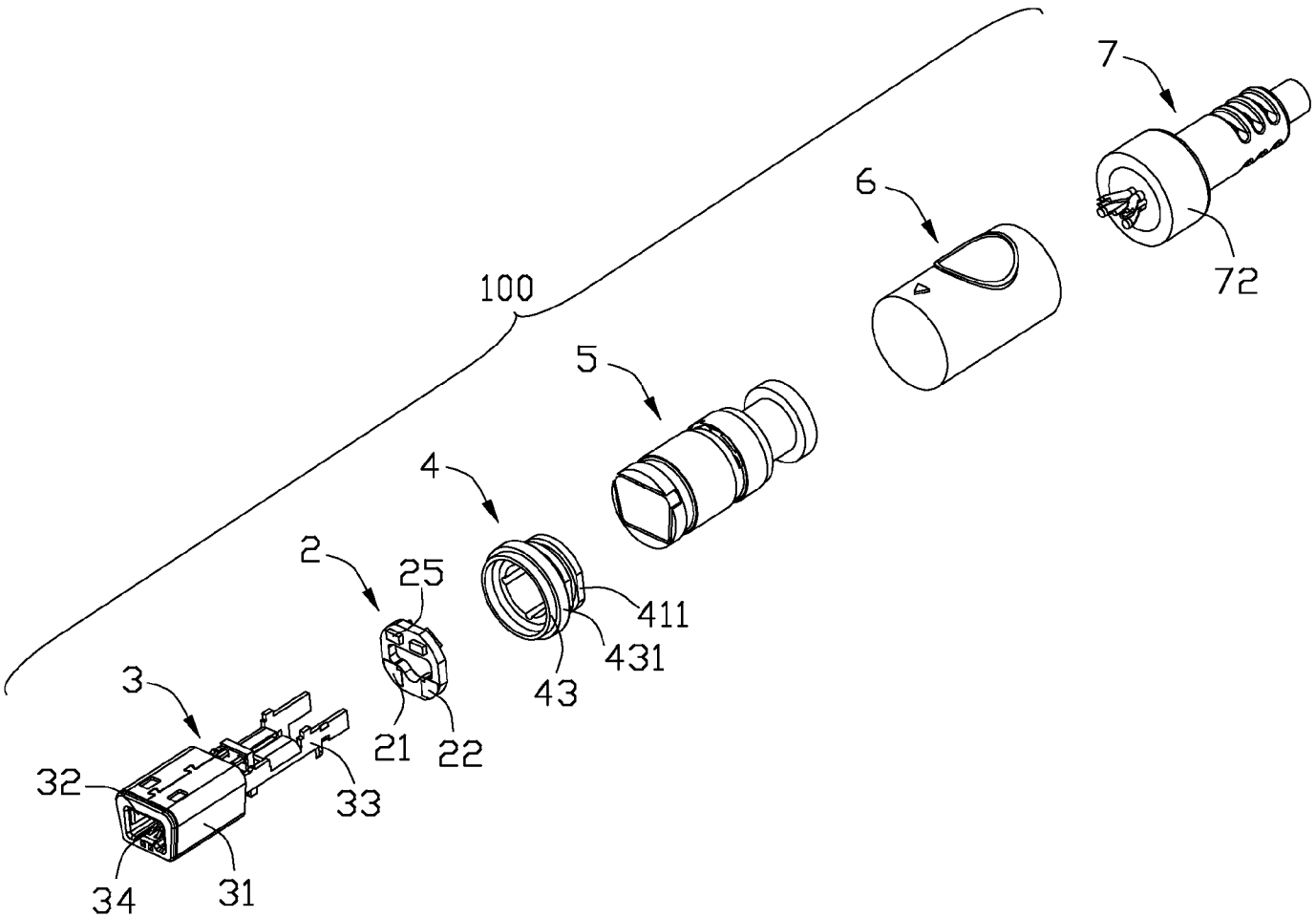
FIG. 2 is an exploded view of the cable connector assembly shown in FIG. 1.
Figure 3:
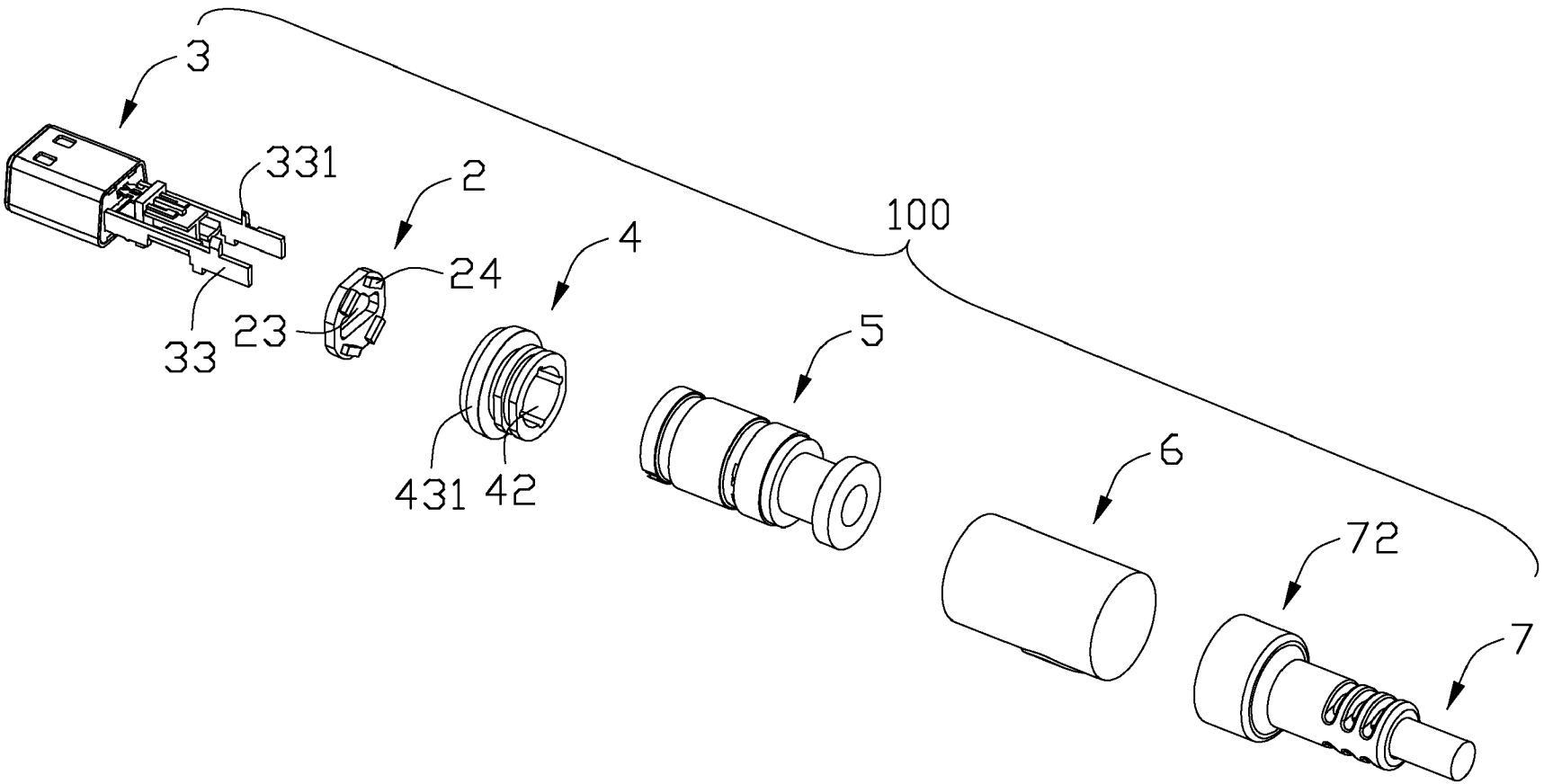
FIG. 3 is a view similar to FIG. 2, but viewed from a different angle.
Figure 4:
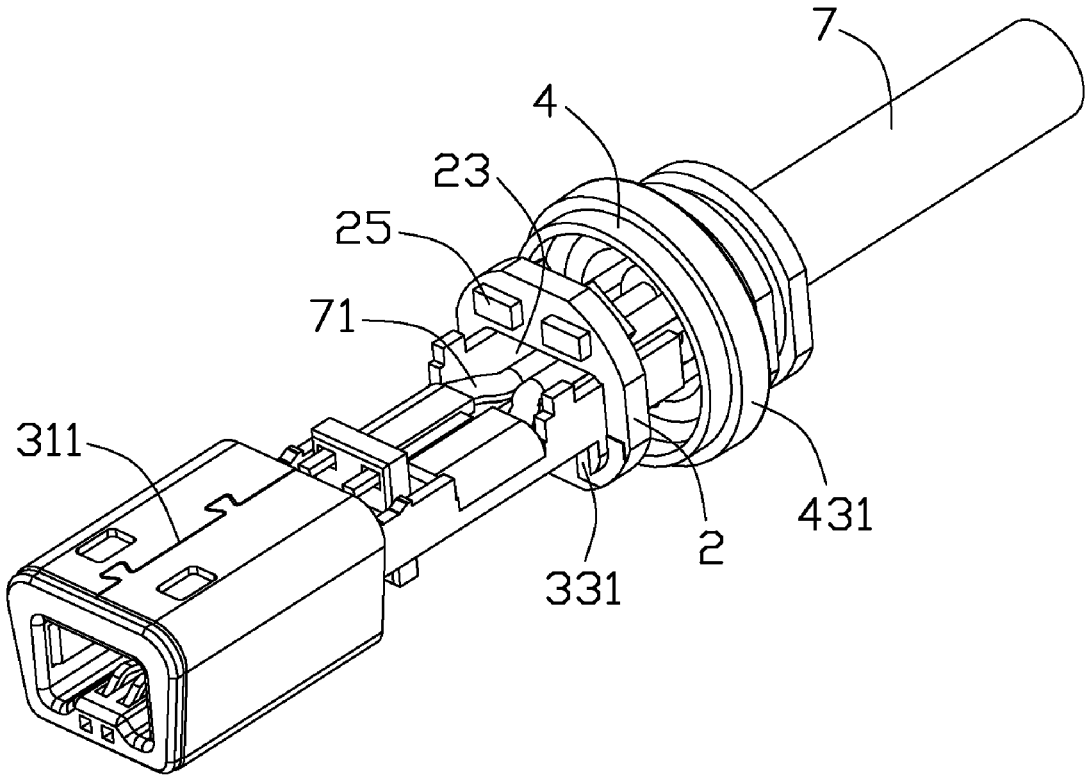
FIG. 4 is a partially assembled, perspective view of the cable connector assembly shown in FIG. 3.
Figure 5:
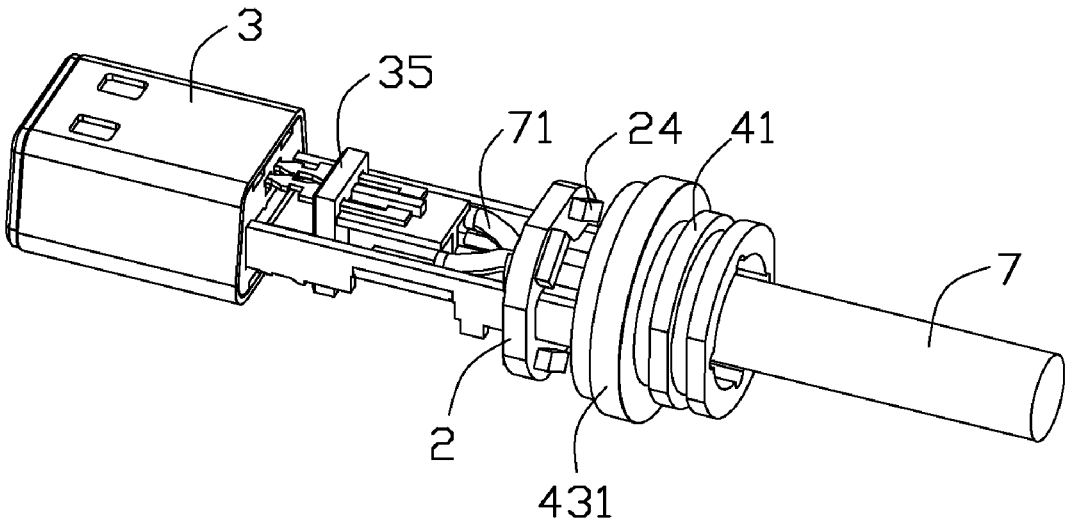
FIG. 5 is similar to FIG. 4, but viewed from another aspect.
Figure 6:
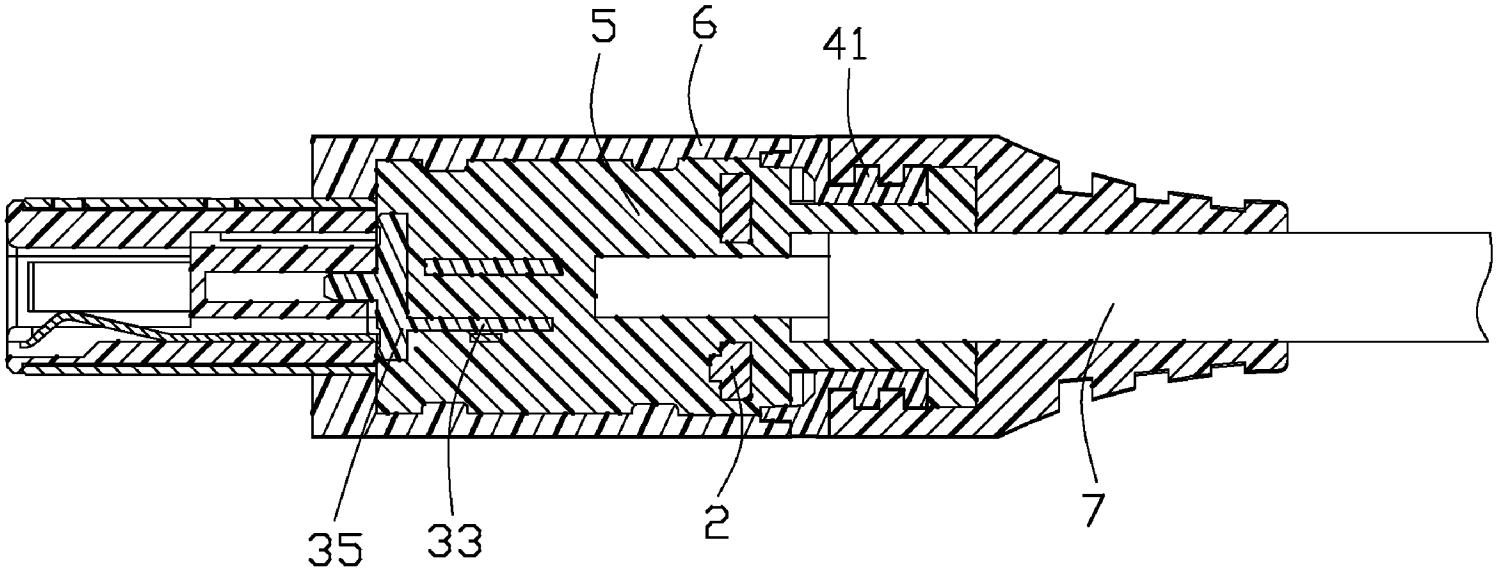
FIG. 6 is a cross-section view take along line 6-6 of FIG. 1.

Referring to FIGS. 2-3, the printed circuit board 2 is arranged along a direction vertical to the mating direction, the mating member 3 and the light pipe 4 are located on opposite sides of the printed circuit board 2. The printed circuit board 2 has a polygonal configuration with a cutout 23 in the middle thereof, and also the printed circuit board 2 has a front surface and a rear surface, the cutout 23 is defined through the front surface and the rear surface. A pair of conductive portions 21, 22 are defined side by side on a lower segment of the front surface of the printed circuit board 2, and the conductive portions 21, 22 are spaced apart from each other along a direction perpendicular to the mating direction. In addition, the printed circuit board 2 defines four Light Emitting Diodes (LED) 24 disposed symmetrically on the rear surface to indicate the work status of the cable connector assembly 100. A pair of resistors 25 are disposed on an upper segment of the front surface.

The mating member 3 comprises a mating section 31 made of metallic material and in the front thereof, an insulative housing (not labeled) enclosed in the mating section 31, a pair of signal contacts 34 received in the insulative housing, a pair of power contacts 33 extending beyond a back end of the mating section 31, and a spacer 35 sandwiched between the pair of the power contacts 35. Each signal contact 34 has a smaller dimension than each power contact 33, so can be distinguished and soldered conveniently. The mating section 31 has a cavity 32 and a slit 311 on a top wall thereof. The signal contacts 34 are received in channels (not labeled) of the cavity 32. Each power contact 33 has a soldering portion 331 extending outwards, and a top wall of the spacer 35 is higher than the power contacts 33 to prevent short circuit.

The light pipe 4 is of cap-shape and has a front section and a back section, the front section has a bigger dimension than the back section. The light pipe 4 is made of transparent plastic material to transmit the light from the LED 24. The light pipe 4 comprises a transmitting portion 43 in the front thereof and a retaining portion 41 behind the transmitting portion 43, and the transmitting portion 43 has a bigger outside diameter than the retaining portion 41. The transmitting portion 43 has a visible area 431 on a rear end of the transmitting portion 43 to indicate the status of the LED 24 for users looking at. The retaining portion 41 has a plurality of ringed ribs (not labeled) and a number of grooves (not labeled) in stagger relationship with the corresponding ribs, and each rib has a pair of planes on lateral sides to avoid the rotation of the light pipe 4 relative to the cable 7. The light pipe 4 is defined with a passageway 42 therethrough.

The cable 7 comprises a strain relief portion 72 for releasing stress and a plurality of wires 71 extending forwardly from the strain relief portion 72.

Referring to FIGS. 2-6, in assembly, the mating member 3 is electrically connected with the printed circuit board 2 via the pair of power contacts 33, the power contacts 33 are passing through the cutout 23 of the printed circuit board 2, the soldering portions 331 are adjacent and soldered to the corresponding conductive portions 21, 22 of the printed circuit board 2. The printed circuit board 2 is located neighboring to a front end surface of the light pipe 4, the wires 71 of the cable 7 are extending through the passageway 42 of the light pipe 4 and the cutout 23 of the printed circuit board 2, and then the wires 71 is soldered to the signal contacts 34 and the power contacts 33 in front of the printed circuit board 2 to increase the soldering area and prevent destroying the electronic components on the printed circuit board 2. And then the inner cover 5 is molded on the assembly of the printed circuit board 2, the mating member 3 and the light pipe 4. The inner cover 5 is made of engineering plastic material to enhance the intensity of the interconnection between the before-mentioned components in a narrow space. Finally, the outer cover 6 is over-molded on the inner cover 5. When the cable connector assembly 100 is assembled, the strain relief portion 72 is enclosing the retaining portion 41 of the light pipe 4, and the visible area 431 is exposed between the outer cover 6 and the strain relief portion 72 to indicate the work status of the cable connector assembly 100, and the strain relief portion 72 is enclosing a back part of the inner cover 5.

The strain relief portion 72 molded on the light pipe 4 can achieve a better conjunction via the plurality of ribs and grooves configured on the light pipe 4, and the cable connector assembly 100 can be swayed repetitiously. Additionally, as the retaining portion 41 defined on the light pipe 4 has an effect of relieving strain, so the cable connector assembly 100 is omitted a conventional ring member to be manufactured easily. The printed circuit board 2 is close to the front end surface of the light pipe 4, so the light from the LED 24 can be transmitted to the visible area 431 and decreased waste.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a mating member assembled with a plurality of contacts, the contacts comprising a pair of signal contacts and a pair of power contacts, and each power contact having a bigger dimension than the signal contact;

a printed circuit board attached with a LED, and the LED electrically connected with the contacts;

a cable having a plurality of wires and a strain relief portion; and a light pipe located between the printed circuit board and the strain relief portion;

wherein the printed circuit board defines a front surface, a rear surface and a cutout extending through the front surface and the rear surface along a mating direction, and the LED is disposed behind the rear surface of the printed circuit board, the wires are extending through the cutout of the printed circuit board and soldered to the contacts in front of the printed circuit board.

2. The cable connector assembly as claimed in claim 1, wherein the cutout is recessed in the middle of the printed circuit board.

3. The cable connector assembly as claimed in claim 2, wherein the printed circuit board is located neighboring to the light pipe.

4. The cable connector assembly as claimed in claim 1, further comprising an inner cover and an outer cover, wherein the inner cover is molded on an electrical connection area between the contacts and the wires, and the outer cover is molded on the inner cover.

5. The cable connector assembly as claimed in claim 4, wherein the inner cover is made of engineering plastic material and has a ringed depression on a back segment, the outer cover is defined in front of the depression, and the light pipe is defined on the depression, the strain relief portion is enclosing a back end of the inner cover.

6. The cable connector assembly as claimed in claim 1, wherein each power contact defines a soldering portion extending outwards, and the printed circuit board has a pair of conductive portions soldered with the corresponding soldering portions.

7. The cable connector assembly as claimed in claim 6, wherein the power contacts are extending through the cutout in the printed circuit board, and the soldering portions are adjacent to the corresponding portions.

8. The cable connector assembly as claimed in claim 7, wherein the printed circuit board defines a plurality of resistors on the front surface thereof, and the resistors are opposite to the corresponding conductive portions.

9. The cable connector assembly as claimed in claim 8, wherein a spacer is disposed between the power contacts, and has an upper wall located higher than a top surface of the power contacts.

10. The cable connector assembly of claim 1, wherein the light pipe defines a transmitting portion and a retaining portion behind the transmitting portion, and the retaining portion has a plurality of ribs and grooves in stagger relationship.

11. The cable connector assembly of claim 10, wherein the transmitting portion has a visible area on a rear end thereof.

12. The cable connector assembly of claim 11, wherein the visible area is exposed between the strain relief portion and an outer cover.

13. A cable connector assembly comprising:

a connector unit including an insulative housing with therein a plurality of signal contacts in a front-to-back direction and with a mating port in a front portion thereof, connector unit further includes a pair of power contacts extending rearwardly through the printed circuit board for not only mechanically and electrically connecting to the printed circuit board but also retaining relative positions between the housing and the printed circuit board in said front-to-back direction;

a printed circuit board located behind the contacts and opposite front and rear surfaces thereof and a cutout extending therethrough in said front-to-back direction;

a cable including a plurality of wires located behind the printed circuit board with said wires extending forwardly through said cutout and electrically and mechanically connected to the corresponding contacts, respectively; and a cover enclosing said connector unit, said wires and said printed circuit board.

14. The cable connector assembly as claimed in claim 13, wherein said pair of power contacts are located by two sides of said signal contacts and extending through said cutout.

15. The cable connector assembly as claimed in clam 13, wherein a plurality of LEDs (Light Emitting Diode) are mounted on the rear surface of the printed circuit board, and a light pipe surrounds said LEDs under condition that a portion of the light pipe is exposed to an exterior.

16. A cable connector assembly comprising:

a connector unit including an insulative housing with therein a plurality of signal contacts in a front-to-back direction and with a mating port in a front portion thereof;

a printed circuit board located behind the contacts and opposite front and rear surfaces thereof and a cutout extending therethrough in said front-to-back direction;

a cable including a plurality of wires located behind the printed circuit board with said wires extending forwardly to electrically and mechanically connect to the corresponding contacts, respectively; and a cover enclosing said connector unit, said wires and said printed circuit board; wherein said connector unit further includes a pair of power contacts extending rearwardly through the printed circuit board for not only mechanically and electrically connecting to the printed circuit board but also retaining relative positions between the housing and the printed circuit board in said front-to-back direction.

17. The cable connector assembly as claimed in claim 16, wherein said pair of power contacts are located by two sides of said signal contacts and extending through said cutout.

18. The cable connector assembly as claimed in claim 16, wherein a plurality of LEDs (Light Emitting Diode) are mounted on the rear surface of the printed circuit board, and a light pipe surrounds said LEDs under condition that a portion of the light pipe is exposed to an exterior.

* * * * *